US007249700B1

(12) United States Patent
Watson et al.

(10) Patent No.: US 7,249,700 B1
(45) Date of Patent: Jul. 31, 2007

(54) COMPACT STORAGE UNIT AND WORKSTATION FOR ROLLED AND/OR COILED MATERIALS

(76) Inventors: Julia Gay Marie Watson, 414 N. Pine St., Janesville, WI (US) 53545; Kim Dietrich Backenkeller, 414 N. Pine St., Janesville, WI (US) 53545

( * ) Notice: Subject to any disclaimer, the term of this patent is extended or adjusted under 35 U.S.C. 154(b) by 83 days.

(21) Appl. No.: 09/940,969

(22) Filed: Aug. 28, 2001

Related U.S. Application Data

(60) Provisional application No. 60/252,615, filed on Nov. 22, 2000.

(51) Int. Cl.
*B26F 3/02* (2006.01)
*A47F 5/08* (2006.01)

(52) U.S. Cl. ..... 225/34; 225/37; 225/38; 312/245

(58) Field of Classification Search ..... 225/17, 225/18, 34, 37, 38; 312/351, 245, 248, 327, 312/328
See application file for complete search history.

(56) References Cited

U.S. PATENT DOCUMENTS 363,372 A * 5/1887 Dollens ..... 312/248
1,245,582 A * 11/1917 Gray ..... 312/245
2,095,227 A * 10/1937 Brown ..... 312/245
2,482,714 A * 9/1949 Mell ..... 225/38
2,521,572 A * 9/1950 Eckel et al. ..... 312/245
2,948,451 A * 8/1960 Swanson ..... 225/38
3,251,638 A * 5/1966 Schwartz ..... 312/245
3,281,032 A * 10/1966 Solomon ..... 225/34
3,317,099 A * 5/1967 Solomon ..... 225/34
3,603,519 A * 9/1971 Brown et al. ..... 225/38
4,876,970 A * 10/1989 Bolduc ..... 312/248
5,301,854 A * 4/1994 Scobey ..... 225/37
5,579,613 A * 12/1996 Carr ..... 52/79.1
6,113,202 A * 9/2000 Germano ..... 312/245

* cited by examiner

*Primary Examiner*—Allan N. Shoap
*Assistant Examiner*—Jason Prone

(57) ABSTRACT

A storage unit/workstation is described which allows efficient storage and use of several rolls of package wrapping material in conjunction with the tools needed to perform such wrapping. The storage unit/workstation includes a cabinet wherein the rolls of wrapping material are mounted to allow the wrapping material to be dispensed by unspooling it from the rolls. A working platform is situated below the cabinet so that the user may place a package on the platform and wrap it with wrapping material pulled from the cabinet. The platform may be stowed when not in use.

13 Claims, 4 Drawing Sheets

COMPACT STORAGE UNIT AND WORKSTATION FOR ROLLED AND/OR COILED MATERIALS

CROSS-REFERENCE TO RELATED APPLICATIONS

This application claims priority under 35 USC §119(e) to U.S. Provisional Patent Application 60/252,615 filed 22 Nov. 2000, the entirety of which is incorporated by reference herein.

FIELD OF THE INVENTION

This disclosure concerns an invention relating generally to storage and shelving cabinets and bureaus, and more specifically to storage units of this nature which are particularly adapted to be used as workstations wherein rolled or coiled materials, particularly wrapping paper and similar materials for wrapping parcels, may be stored, dispensed, and operated upon.

BACKGROUND OF THE INVENTION

In businesses where gift or package wrapping is performed, wrapping is often time-consuming owing to the need to collect and organize various tools and materials—wrapping paper, tape, scissors, bows, labels, writing implements, etc.—and then use them to wrap or otherwise operate upon the gift or package. Additionally, the act of wrapping a package or gift wrapping is space intensive. This is problematic since in package shipping stores, wherein packages of various shapes and sizes must be wrapped and labeled for delivery, space is at a premium. To maintain low overhead, these businesses tend to be housed in small retail locations wherein it may be difficult to reserve suitable counter space for wrapping, and/or to situate wrapping materials readily at hand. These businesses also depend on quick turn-around time for wrapping packages, which can be burdensome owing to the space constraints. It is difficult to store the necessary tools within easy reach, particularly since the wrapping tools and materials tend to get "lost" during the wrapping process as they are covered up by the wrapping paper and/or are shifted around during the wrapping process. The act of wrapping is often difficult to perform with two hands; for instance, if it is necessary to hold the package and wrapping paper together with two hands, no hands may be free to reach tape or other materials needed for the next step of the wrapping process.

People who work on crafts and holiday gift-wrapping in their homes encounter many of the same problems as noted above. It would therefore be helpful to have a storage unit available for the various wrapping materials wherein the unit not only stores the materials, but also keeps them readily at hand and dispenses them, and also serves as a convenient workstation wherein wrapping may be performed without the need to clear a counter, table, or other work area that may already be occupied by other tasks.

SUMMARY OF THE INVENTION

The invention involves a storage unit and workstation for wrapping material which is intended to at least partially solve the aforementioned problems. To give the reader a basic understanding of some of the advantageous features of the invention, following is a brief summary of certain preferred versions of the storage unit/workstation. As this is merely a summary, it should be understood that more details regarding the preferred versions may be found in the Detailed Description set forth elsewhere in this document. The claims set forth at the end of this document then define the various versions of the invention in which exclusive rights are secured.

The storage unit/workstation is intended to hold and dispense several rolls and/or sheets of wrapping material, and all tools and supplies needed to wrap an item, including tape, scissors, bows, wrapping paper, ribbon, cards, wire, tape, glue, rulers, staplers, etc. The storage unit/workstation conveniently arrays all items for convenient access during the wrapping operation, and also protects the wrapping material from the damage that can occur due to improper storage. A preferred version of the wrapping material storage unit/workstation can be best envisioned with reference to FIGS. 1 and 2. The storage unit/workstation includes a cabinet having a cabinet interior bounded by opposing upper and lower cabinet walls, and opposing side cabinet walls extending between these upper and lower cabinet walls. A spindle for receiving a roll of wrapping material is removably affixed with respect to at least one of the side cabinet walls to allow installation and removal of a roll of wrapping material thereon. The spindle is at least substantially horizontally oriented between the side cabinet walls so that a user may pull the end of the roll and unspool wrapping material from the roll, supplying the user with wrapping material with which the user may wrap gifts or packages.

To assist the wrapping process, a working platform is situated below the spindle in front of the cabinet so that a user may pull wrapping material from the spindle and onto the working platform, whereupon the user may place the package atop the wrapping material for wrapping (and unspool further wrapping material from the spindle as needed). The working platform is shown in its working position in FIG. 2, wherein it is situated in an at least substantially horizontal plane below the spindle. The working platform is preferably movable from its working position to a storage position out of the area in front of the cabinet, thereby leaving the space in front of the cabinet unobstructed, which is beneficial in environments wherein space is a concern. Most preferably, removal of the working platform to the storage position is allowed by providing the working platform as a cabinet door which is hingedly affixed to the cabinet to allow it to swing between its fully open working position (FIG. 2) and its closed position (FIG. 1). Alternatively, the working platform may be provided as a drawer-like member which may be inserted within and withdrawn from the cabinet or surrounding structure, or otherwise providing the working platform with the ability to be rigidly mounted in front of the cabinet and below the spindle. To assist such rigid mounting when the working platform is provided in the form of a cabinet door, foldable restraining arms (shown at 120 in FIG. 2) are preferably provided between the door and the cabinet to prevent the working platform from folding beyond its fully open working position. For the convenience of the user, the working platform preferably bears regularly spaced indicia thereon (such as a grid or similar metered pattern of markings) to allow easy measurement of wrapping material situated on the working platform.

To allow easy cutting/tearing of wrapping material without the need for separate cutting implements, the storage unit/workstation preferably includes one or more rip bars which extend at least substantially parallel to each spindle, and which are spaced therefrom, so that wrapping material spooled from the spindle may be forced against the edge of the rip bar(s) to tear the wrapping material along the edge. Such rip bars may be provided adjacent to one or more of the spindles (as depicted by the pair of closely spaced rip bars 138 in FIG. 2). The rip bar(s) may alternatively be provided at the working platform, as by defining an elongated guide slot on or within the working platform through which wrapping material may be inserted, with the user then being able to tear the wrapping material by forcing it against the edge of the guide slot. A guide slot of this nature is illustrated in FIG. 2 between the cabinet door 116 and rip bar 134.

One or more shelves may be situated within the cabinet interior above the spindle, thereby allowing storage of items on the shelf so that they are easily accessible from the working platform, but so that they do not rest within the path of wrapping material being unspooled from the spindles, and do not otherwise clutter or obstruct the working platform to interfere with wrapping operations. For convenient use (and also inexpensive manufacturing) of the storage unit/workstation, it is also useful to provide an insertable dividing unit which is adapted to closely fit within a space in the cabinet interior above the shelf (see FIGS. 4 and 5 for an exemplary dividing unit 400), with the dividing unit bearing one or more partition walls which compartmentalize the space above the shelf. As best seen in the exemplary dividing unit of FIG. 4, the dividing unit may include a front dividing unit wall with access apertures defined therein, and intersecting horizontal and vertical partitioning walls situated behind and perpendicular to the front dividing unit wall to compartmentalize the cabinet interior behind the access apertures.

In alternative versions of the storage unit/workstation, the aforementioned spindles are omitted and their functionality is provided by an insertable roll rack which is adapted to closely fit within the cabinet interior (as depicted in FIGS. 3 and 5–10). As best seen in FIGS. 5, 7, and 9, each roll rack includes a front rack wall having one or more access apertures defined therein, with each access aperture being elongated in an at least substantially horizontal direction so that wrapping material can be pulled therefrom. Below each access aperture, rack shelves extend rearwardly from the front rack wall so that they may support rolls of wrapping material thereon to supply the wrapping material through their corresponding access apertures. The rack shelves may be horizontally oriented, as in FIG. 5; may be upwardly sloping, as in FIG. 7, to urge rolls of wrapping material towards their corresponding access apertures (see FIG. 8); and/or may include upwardly and forwardly sloping portions, as in FIG. 9, so that the roll of wrapping material immediately adjacent the access aperture is allowed to freely unspool without interference from other rolls of wrapping material on the rack shelf (with these other rolls being situated between the forwardly sloping portion and the rear wall of the cabinet, as shown in FIG. 10). It is also possible to provide arrangements such as these wherein the various rack shelves are not provided in integrally-formed roll racks, but are instead provided as separate insert shelves (as in FIGS. 11, 12, and 13) which may be removably installed within the cabinet of the storage unit/workstation as the user pleases.

Further advantages, features, and objects of the invention will be apparent from the following Detailed Description of the Invention in conjunction with the associated drawings.

DETAILED DESCRIPTION OF PREFERRED EMBODIMENTS OF THE INVENTION

Figure 1:
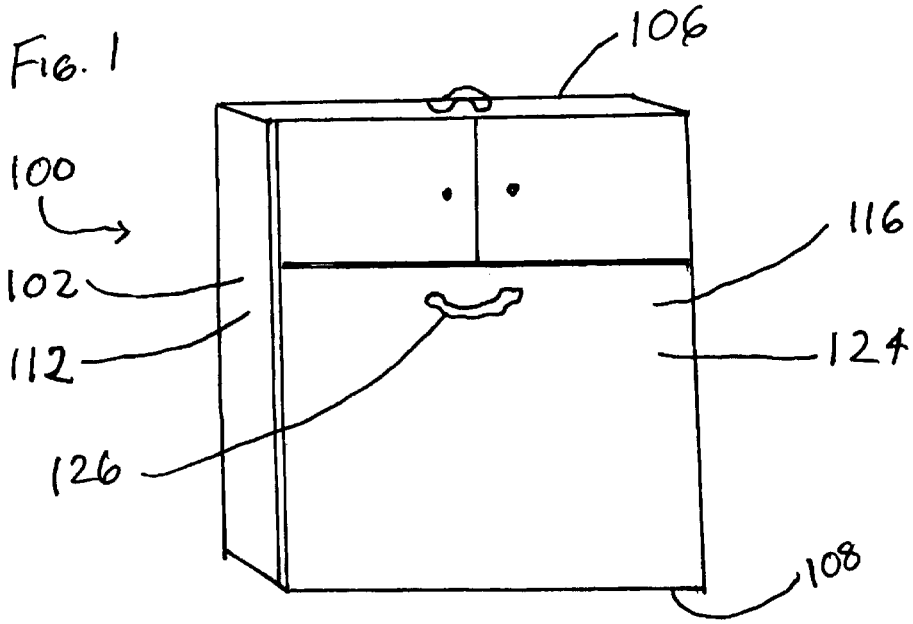
FIG. 1 is a front perspective view of a first embodiment of a wrapping material storage unit/workstation shown with its doors in the closed position.
Figure 2:
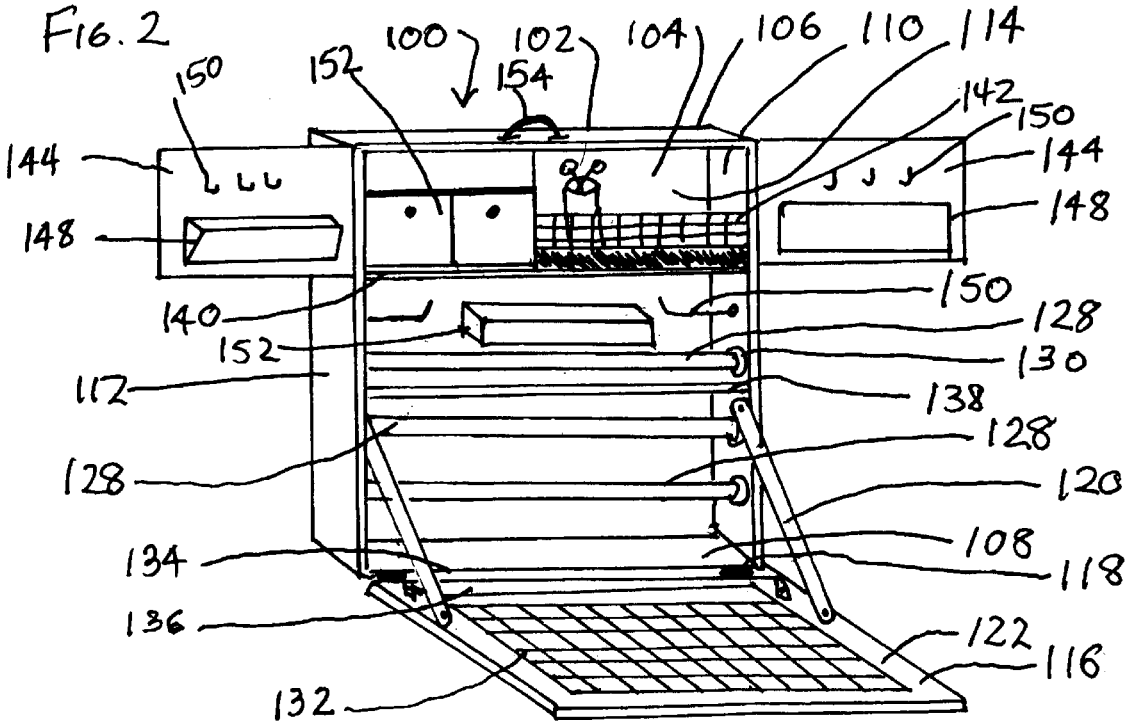
FIG. 2 is a front perspective view of the wrapping material storage unit/workstation of FIG. 1 shown with its doors in their fully open positions.

Referring to FIGS. 1 and 2 of the drawings, a first embodiment of the wrapping material storage unit/workstation is designated by the reference numeral 100. The storage unit/workstation 100 includes a cabinet 102 with a cabinet interior 104 (shown in FIG. 2) defined therein, the cabinet interior 104 being bounded by an upper cabinet wall 106, an opposing lower cabinet wall 108, and opposing right and left cabinet walls 110 and 112 extending between the upper and lower walls 106 and 108. A rear cabinet wall 114 joining the cabinet walls 106, 108, 110, and 112 at their rear edges is also preferably included. A main cabinet door 116, shown in its fully closed position in FIG. 1 and in its fully open position in FIG. 2, is pivotally affixed to the lower cabinet wall 108 by a door hinge 118. When the cabinet door 116 is in its fully open position, the interior door surface 122 rests in an at least substantially horizontal plane whereby it defines a working platform in front of the cabinet interior 104, thereby allowing personnel to swing the cabinet door 116 to its fully open working position, access items within the cabinet interior 104, and place them on the working platform (interior door surface) 122 to begin work. One or more foldable restraining arms 120 extends from a side cabinet wall 110 and/or 112 to affix to the interior surface 122 of the cabinet door 116 and thereby prevent it from folding outwardly further than its fully open position. The exterior surface 124 of the cabinet door 116 preferably bears a handle 126 thereon to allow user to more easily open the cabinet door 116 to access the cabinet interior 104.

Within the cabinet interior 104, one or more spindles 128 extend between the side cabinet walls 110 and 112 in an at least substantially horizontal orientation, with the spindles 128 being suitable for axial insertion within rolls of wrapping material to allow spooling of the wrapping material off of the spindles 128. Such wrapping material may be decorative wrapping paper, tissue paper, manila paper, foil, cellophane/plastic wrap, or other flexible sheet material. The spindles 128 are removably affixed with respect to at least one of the side cabinet walls 110 and 112 to allow removal of the spindles 128, placement of rolls of wrapping material thereon, and replacement of the spindles 128 within the cabinet interior 104. Such removable affixation of the spindles to the side cabinet walls 110 and 112 can be effected in a number of different ways, for example, by situating the spindles 128 within bearings 130 such as those commonly used for mounting closet rods (wherein the bearings 130 bear slots allowing insertion and removal of the spindles); affixing the spindles 128 to the cabinet side walls 112 and 114 by use of removable and replaceable fasteners; sliding the ends of spindles 128 within slots defined in the cabinet side walls 110 and 112; and so forth. The spindles 128 are preferably situated in a lower portion of the cabinet interior 104 so that wrapping material spooled off of the spindles 128 will be in close proximity to the working platform provided by the interior door surface 122, thereby allowing unspooled wrapping material to rest on the working platform to allow a package thereon to be wrapped. It is therefore helpful to provide the interior door surface 122 with a regular grid 132, or other indicia spaced at regular intervals (e.g., markings at every inch or centimeter), to allow easy measurement of wrapping material placed on the interior door surface 122. Once the wrapping material is measured, it may be cut by a utility knife or similar implement (which might be affixed by a cord to the cabinet interior 104 or otherwise ordinarily situated within the cabinet interior 104).

However, it is also useful to provide the storage unit/workstation 100 with independent means for cutting the wrapping material so that no scissors or other separate (and easily lost) cutting tools are required. A first preferred version of a means for cutting wrapping material may be provided by defining an elongated guide slot on the cabinet door 116, so that wrapping material may be fit through the guide slot and torn along the edge of the slot. While such a guide slot may be defined within the cabinet door 116 so that it extends from the interior door surface 122 to the exterior door surface 124, a more preferred guide slot configuration is provided by affixing the ends of an elongated rip bar 134 on the interior door surface 122, so that a major portion of the rip bar 134 is spaced from the interior door surface 122. A guide slot 136 is then defined by the space between the rip bar 134 and the interior door surface 122. Wrapping material may thus be unspooled from the spindles 128 and extended through the guide slot 136 and atop the interior door surface 122, so that the wrapping material may be lifted from the interior door surface 122 and forced against the rip bar 134 to tear it.

A second preferred version of a means for cutting wrapping material may be provided by situating one or more rip bars parallel to and spaced from the spindles 128, whereby wrapping material extending from the spindles 128 may be forced against one or more of the rip bars to tear the wrapping material. Such an arrangement is provided by the pair of rip bars 138 shown in FIG. 2, which are in the form of metal rods situated in close parallel relationship so that wrapping material may fit between them as it is rolled off the adjacent spindle 128. By pulling the wrapping material against the rip bars 138, a user may tear the wrapping material in a generally straight line.

Within the cabinet interior 104, a cabinet shelf 140 is situated above the spindles 128. The cabinet shelf 140 allows storage of items above both the spindles 128 and the working platform provided by the interior door surface 122. The stored items are therefore readily accessible to users, but out of the way of wrapping material pulled from the spindles 128 so that the items are not in the way of wrapping operations. The cabinet shelf 140 is preferably removably inserted within the cabinet interior 104, as by situating its opposing ends within slots defined in the cabinet walls 110 and 112, or by situating it atop protrusions (not shown) extending from the cabinet walls 110 and 112.

The cabinet shelf 140 preferably has a front ledge to prevent items from easily falling from the cabinet shelf 140. In the storage unit/workstation 100 depicted in FIGS. 1 and 2, such a ledge is provided by a piece of flexible webbing 142 extending between (and affixed) to the cabinet walls 110 and 112.

The portion of the cabinet interior 104 situated above the cabinet shelf 140 may be closed off by the cabinet door 116 if desired, but the storage unit/workstation 100 of FIGS. 1 and 2 illustrates a preferred arrangement wherein it is separately accessible via opposing doors 144 pivotally affixed to the side cabinet walls 110 and 112 via hinges. Door pockets 148 may be affixed to the interior surfaces of the doors 144 so that items may be situated therein. This has the added benefit of effectively expanding the width of the cabinet shelf 140, allowing a user to horizontally array a range of items across the door pockets 148 and atop the cabinet shelf 140 for easy access during the wrapping process. The flexible webbing 142 is beneficial because it may buckle when the doors 144 are closed and the door pockets 148 are swung into contact with the webbing 142. Common cabinet latches (not shown) may retain shut the doors 144, as well as the cabinet door 116, when they are swung into the closed position.

Free space within the cabinet interior 104 may be provided with a wide variety of storage implements for storage of items such as rolls of ribbon or tape, scissors, staplers, etc. In FIG. 2, elongated hooks 150 are shown extending from the cabinet side walls 110 and 112 so that rolls of ribbon may be situated thereon, and spooled off of the hooks 150, for easy use. One or more bins 152, which are preferably made of plastic and which may be affixed to the rear cabinet wall via fasteners, may be situated between the hooks 150. It should be understood that hooks 150, bins 152, and other such implements may be arrayed about the cabinet interior 104 in a variety of locations, and that they may take a variety of forms other than those mentioned here.

The storage unit/workstation 100 is preferably formed with relatively shallow depth so that it does not protrude significantly outwardly from a wall when mounted thereon, but its width should be such that it accommodates standard rolls of wrapping material, and its height should be such that the working platform provided by the interior door surface 122 is suitably sized for standard wrapping operations. Preferred dimensions are approximately 33 inches wide, by 35 inches high, by 6 inches deep. The storage unit/workstation 100 is preferably primarily formed of wood or pressed board, though plastic, metal, or any other suitable material may also be used.

The storage unit/workstation 100 is preferably provided with a top handle 154 so that it is rendered easily portable, allowing it to be removed from a wall and carried for use at different locations as the situation demands. Additionally, the storage unit/workstation 100 is preferably dimensioned so that it may be inserted within standard cabinets (e.g., kitchen cabinets, which tend to be formed in a few standard sizes) for easy storage when desired. If the storage unit/workstation is sized and configured to serve as an insert within existing cabinets, its cabinet may be inexpensively formed of thin thermoformed plastic (or similar thin materials) since the insertion of the storage cabinet within the cavity of the standard cabinet may provide it with sufficient rigidity that it has working strength. The storage unit/workstation cabinet need not necessarily include doors, since the door of the standard cabinet may suffice. In similar fashion, the storage unit/workstation might be formed as an insert that may be situated in a hole cut in a wall, so as to form a flush-mounted wall cabinet.

Figure 3:
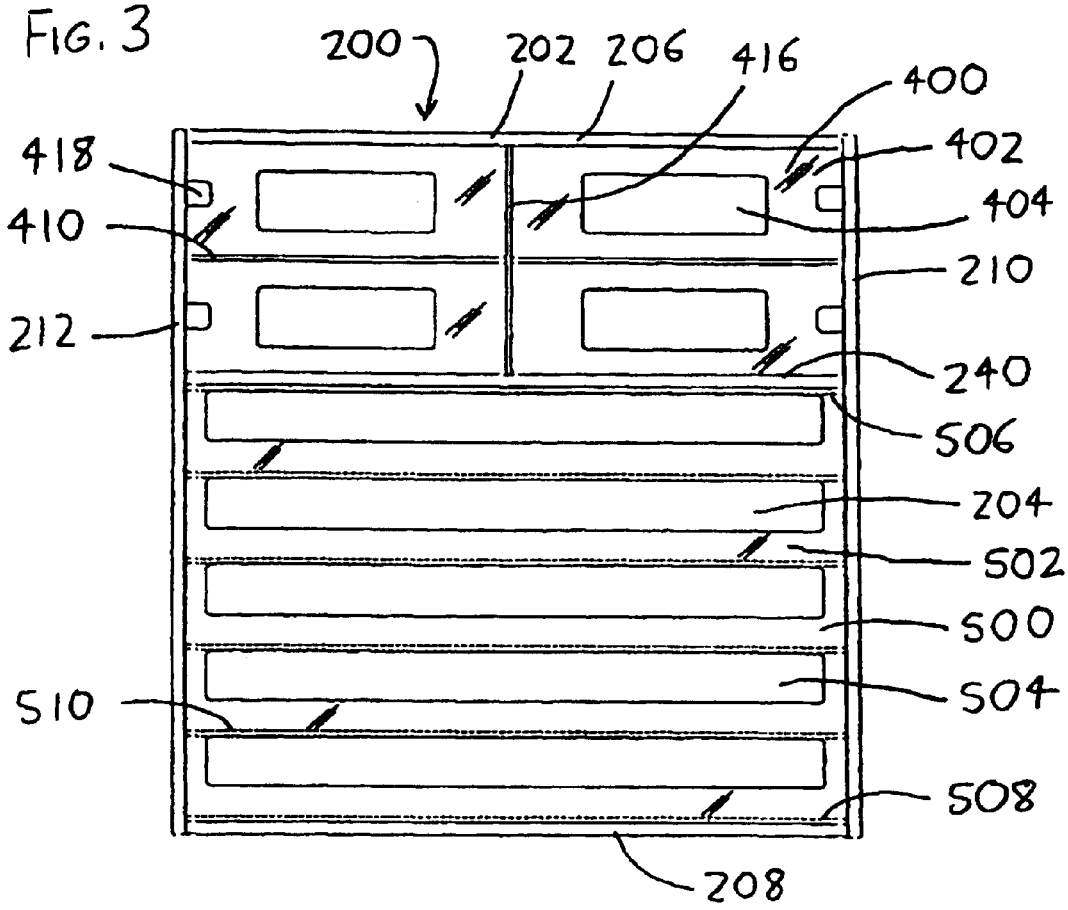
FIG. 3 is a front elevational view of a second embodiment of a wrapping material storage unit/workstation, shown with its doors removed and illustrating an insertable dividing unit 400 and an insertable roll rack 500.
Figure 4:
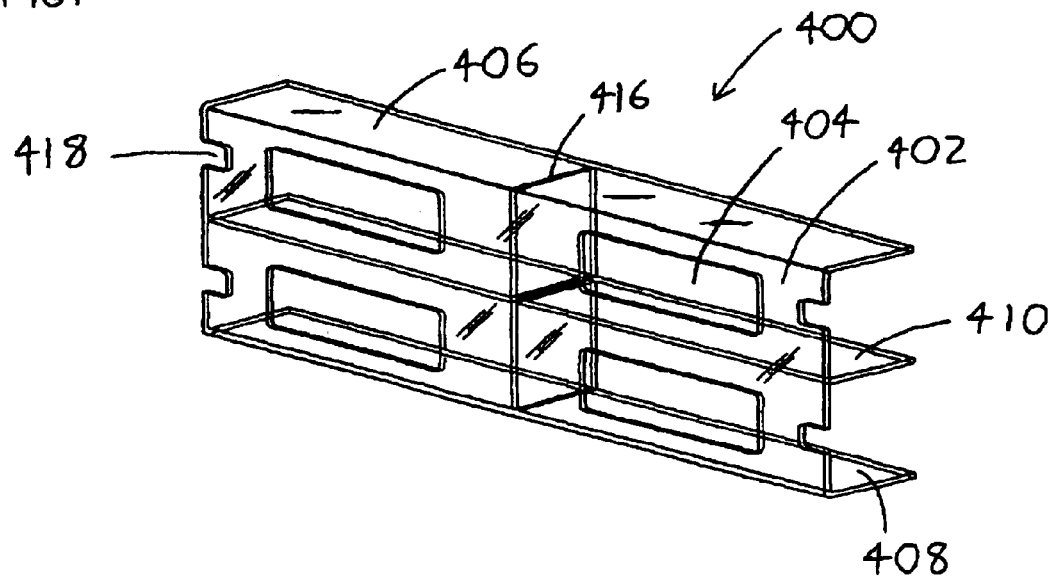
FIG. 4 is a perspective view of the dividing unit 400 of FIG. 3.
Figure 5:
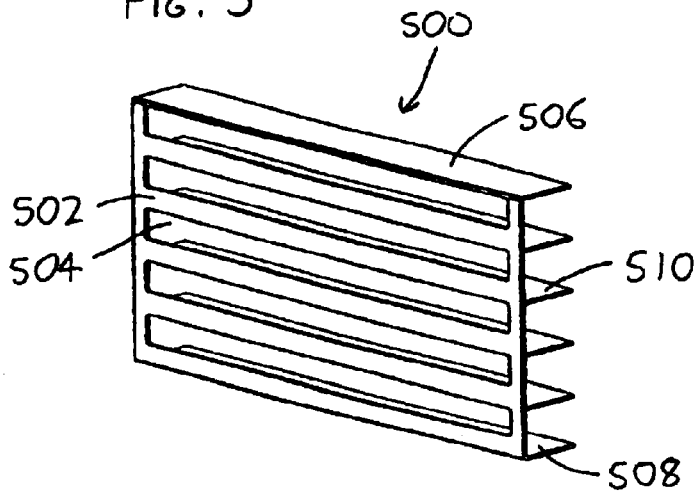
FIGS. 5, 7, and 9 are perspective views of alternative versions of roll racks suitable for supporting multiple rolls of wrapping material within the wrapping material storage unit/workstation of FIG. 3.
Figure 6:
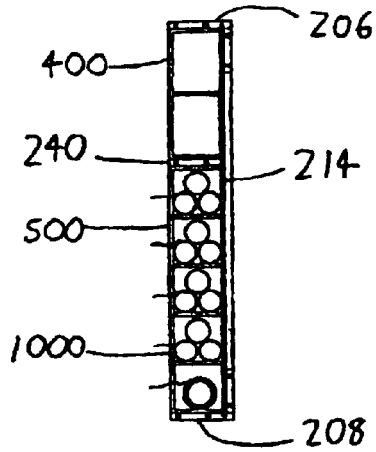
FIGS. 6, 8, and 10 respectively show side elevational views of the roll racks of FIGS. 5, 7, and 9 installed within the wrapping material storage unit/workstation of FIG. 3, with the storage unit/workstation being shown sectioned along a vertical plane which cuts the storage unit/workstation along its depth and height.
Figure 7:
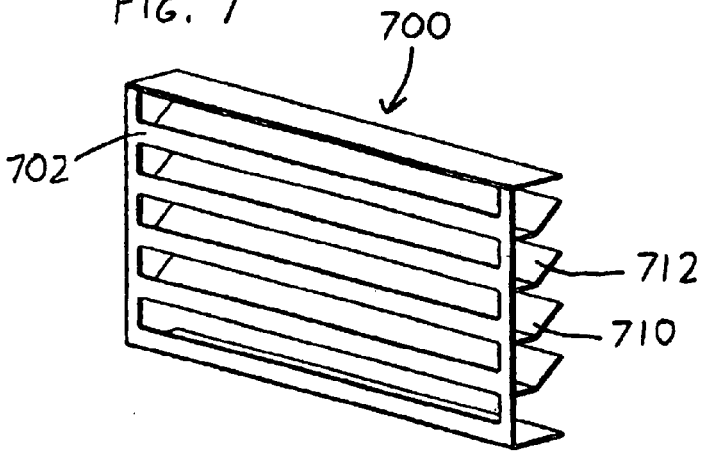

FIG. 3 illustrates a storage unit/workstation with a second set of storage units 200 with its doors removed for sake of simplicity. The storage unit/workstation 200 includes a cabinet 202 with a cabinet interior 204 bounded by an upper cabinet wall 206, lower cabinet wall 208, right cabinet wall 210, left cabinet wall 212, and rear cabinet wall 214 (FIG. 6). A cabinet shelf 240 extends between the side cabinet walls 210 and 212. Rather than storing wrapping material on spindles within the storage unit/workstation 200, the wrapping material storage and dispensing function is provided by an insertable roll rack 500 situated below the cabinet shelf 240. As will be discussed at greater length elsewhere in this document, a variety of roll racks of different configurations are possible, and several different embodiments of roll racks are illustrated in FIGS. 5, 7, and 9 at 500, 700, and 900, with views of these roll racks installed within the storage unit/workstation 200 being illustrated in FIGS. 6, 8, and 10. The storage unit/workstation 200 of FIG. 3 also includes an insertable dividing unit 400 (shown alone in FIG. 4) atop the cabinet shelf 240. The various roll racks 500 (FIGS. 3, 5 and 6), 700 (FIGS. 7 and 8) and 900 (FIGS. 9 and 10) will first be described.

With reference to FIGS. 3, 5, and 6, the roll rack 500 includes a front rack wall 502 having a series of elongated access apertures 504 defined therein. Top and bottom flanges 506 and 508 are situated at the top and bottom edges of the front rack wall 502 to abut the cabinet shelf 240 and lower cabinet wall 208 when the roll rack 500 is inserted within the cabinet interior 204. The roll rack 500 is preferably formed of clear acrylic or some other transparent and resiliently flexible material, though it may be formed of an opaque and/or rigid material if desired. The roll rack 500 is preferably tightly fit within the cabinet interior 204 such that it is not easily dislodged when wrapping material 1000 is pulled from its access apertures 504, but if desired the roll racks 500 may be made more difficult to dislodge by providing structure on the cabinet walls 208, 210, and/or 212, and/or on the cabinet shelf 240, which releasably retains the roll rack 500 within the cabinet interior 204. For example, protruding pegs may be situated on the bottom of the cabinet shelf 240 to protrude downwardly, and/or on the top side of the lower cabinet wall 208 to protrude upwardly, with these pegs fitting within complementary apertures in the top and bottom flanges 506 and 508 of the roll rack 500 (this arrangement not being shown in the Figures). Provided the roll rack 500 is sufficiently flexible, it can be bent to engage and/or disengage the pegs as desired. The roll rack 500 can additionally or alternatively be releasably retained within the cabinet interior by a variety of other means, such as by removable fasteners, hook and loop fasteners, wedges, or other common measures which should be apparent to one of ordinary skill.

A series of rack shelves 510 extend rearwardly from the front rack wall 502 beneath each access aperture 504, with the lowermost rack shelf 510 being defined by the bottom flange 508, so that each rack shelf 510 may support one or more rolls of wrapping material 1000 (see FIG. 6). Thus, rolls of wrapping material 1000 situated on the rack shelves 510 may be spooled through the access apertures 504 by the user, and situated on the working platform/interior door surface of the storage unit/workstation 200 (not shown in FIG. 2), so that the user may operate upon the wrapping material 1000. The user may additionally force the wrapping material 1000 against the edge of the front rack wall 502 bounding the access aperture 504 so that this edge of the front rack wall 502 serves as a rip bar. While the heights of the access apertures 504 may be such that rolls of wrapping material may be inserted through them to rest upon the rack shelves 510, the heights of the apertures 504 are preferably such that the rolls of wrapping material 1000 will not fit through the access apertures 504, thereby preventing the rolls from falling from the access apertures 504 when pulled too forcefully. Instead, the rolls of wrapping material 1000 are installed by situating them on the rack shelves 510 of the roll rack 500, and then inserting the roll rack 500 within the cabinet interior 204 beneath the cabinet shelf 240 so that the wrapping material rolls 1000 are situated within the cabinet interior behind the front rack wall 502.

Figure 8:
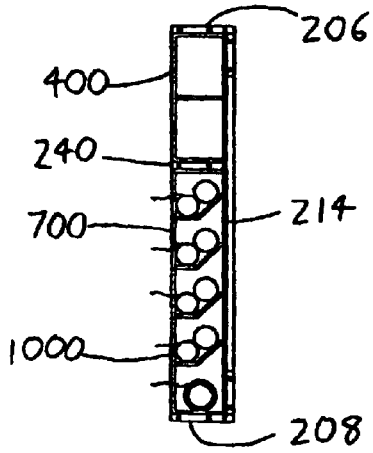
Figure 9:
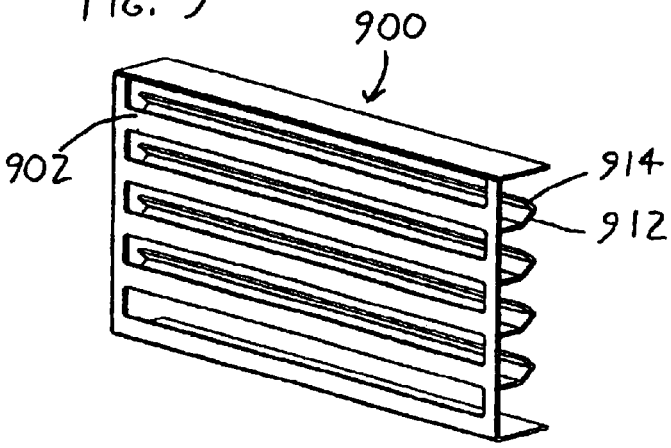

Another preferred version of a roll rack is depicted in FIGS. 7 and 8 by roll rack 700. In this embodiment, the rack shelves 710 include upwardly sloping portions 712 which urge rolls of wrapping material situated on the rack shelves 710 towards the front rack wall 702, thereby helping to provide rolls of wrapping material 1000 immediately available adjacent the front rack wall 702.

Figure 10:
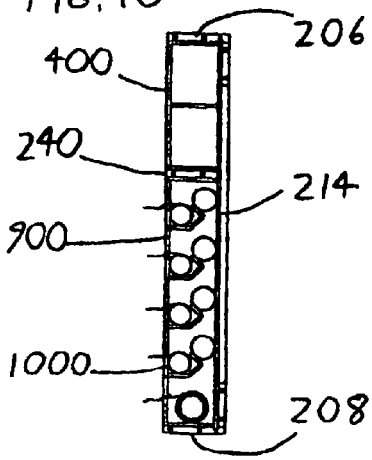

A further preferred version of a roll rack is depicted in FIGS. 9 and 10 by roll rack 900, wherein the rack shelves extending from the front rack wall 902 also include upwardly sloping portions 912, and additionally include upwardly and forwardly sloping portions 914 which extend towards the front rack wall 902. As depicted in FIG. 10, the upwardly sloping portions 912 help to urge rolls of wrapping material 1000 towards the front rack wall for easy accessibility, but the upwardly and forwardly sloping portions 914 also help to provide (in conjunction with the rear cabinet wall 214) a valley wherein unused rolls of wrapping material may be situated. Thus, as shown in FIG. 10, the supplementary rolls do not ride against (and potentially interfere with) the rolls of wrapping material 1000 being used, which is a possible occurrence in the roll racks 500 and 700 depicted in FIGS. 6 and 8.

Returning particularly to FIGS. 3 and 4, the exemplary dividing unit 400 will now be described. The dividing unit 400 is adapted to closely fit within the cabinet interior 204 above the cabinet shelf 240 in a manner generally similar to the roll racks described previously. The dividing unit 400 includes a front dividing unit wall 402 having one or more access apertures 404 defined therein, a flexible top flange 406 to be situated against the bottom surface of the upper cabinet wall 206, a flexible bottom flange 408 to be fit against the top surface of the cabinet shelf 240, and horizontal partitioning walls/shelves 410 each situated beneath one of the access apertures 404 (with the lowermost dividing unit shelf 410 being provided by the bottom flange 408). One or more vertical partitioning walls 416 may also be provided which intersect the horizontal partitioning walls 410, and thereby horizontally partition the space behind the front dividing unit wall 402 into separate compartments. The access apertures 404 preferably have such significant size that a user may insert his/her hand therein and pull items such as tape, scissors, balls of string, etc. from the compartments defined behind the access apertures 404. Thus, a user may situate different items within different compartments as desired. Since the dividing unit 400 is to be tightly retained within the cabinet interior 204, side notches 418 may be defined in the front dividing unit wall 402 to allow a user to more easily grasp the dividing unit 400 and pull it from the cabinet shelf 240. (Similar notches may be provided in the previously-noted roll racks if desired.) The dividing unit 400 is preferably formed of clear acrylic or some other transparent and resiliently flexible material, though it may be formed of an opaque and/or rigid material if desired.

Figure 11:
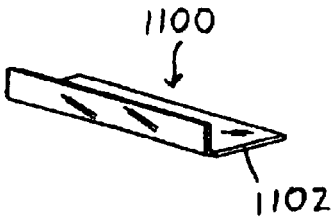
FIGS. 11, 12, and 13 are perspective views of alternative versions of the roll racks of FIGS. 5, 7, and 9, wherein the rack shelves of those roll racks are provided as units which are removably insertable within the cabinets of the storage unit/workstations of FIGS. 1 and 2.
Figure 12:
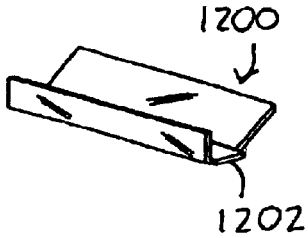
Figure 13:
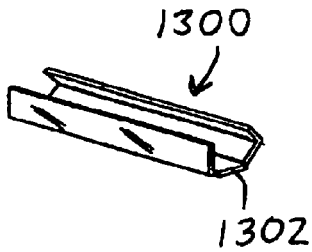

FIGS. 11, 12, and 13 then illustrate rack shelves 1100, 1200, and 1300 which may be used in place of the roll racks

500, 700, and 900 within the cabinets 102/202 of the storage unit/workstations 100/200. These rack shelves have laterally-extending tabs 1102, 1202, and 1302 which may be received within complementarily-formed slots in the cabinet side walls (not shown in FIGS. 2 and 3), thereby allowing each rack shelf to be inserted into desired positions in the cabinet. The rack shelves could alternatively be individually installed at desired locations within the cabinet by other means of attachment, such as by removable fasteners or the like.

The various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

Initially, the main doors of the storage units/workstations previously described need not be configured in the forms noted previously, and may take other forms. For example, rather than forming the main doors as integrally-formed planar boards, they may instead be formed of several segments which are hingedly joined to unfold to define a working platform. In the event that the cabinet of the storage unit/workstation is not provided with one or more doors which closes the cabinet interior—as in the case where the storage unit/workstation is formed as an insert within a standard cabinet, and the standard cabinet doors are used to close the storage unit/workstation—the working platform may be provided, for example, by a board which can be affixed in a generally horizontal orientation in front of the cabinet to provide the working platform. Such a board might be provided as a drawer-like insert which fits within (and may be pulled from) a slot near the base of the storage unit/workstation cabinet, or may be provided separately for attachment to the cabinet or surrounding structure.

In similar fashion, the spindles need not be provided in the form shown, and may be provided as bars, a pair of axially aligned pegs which receive opposing ends of a roll of wrapping material, or other forms. Spindles such as those shown in FIG. 1 could also have their ends situated within tracks formed in the cabinet side walls so that a user may move the spindles to various locations within the cabinet; for example, the track on each cabinet side wall may be provided in the form of a closed loop so that a user may index selected spindles (and the rolls of wrapping material thereon) to the front of the cabinet for easy reach, with non-selected spindles being pushed further into the interior of the cabinet for later selection. As an alternative to this indexing arrangement, the opposing cabinet side walls may bear axially aligned rotatable wheels, wherein a number of spindles extend between the wheels from their peripheries, so that a user may rotate the wheels to bring a selected spindle to the front of the cabinet. Such wheels may include a ratcheting mechanism or lock whereby the bars can be fixed against rotation when desired; for instance, the wheels may provide high resistance to rotation unless they are rotated to positions where one of the spindles is located frontmost within the cabinet, so that the user can "click" the different spindles from one index position to the next.

The restraining arm 120 shown in FIG. 2, if provided, may take forms other than the pivoting linkage shown in FIG. 2. For example, it may be provided by a chain, cord, or other folding member extending from one or more portions of the cabinet door to one or more portions of the cabinet.

The dividing unit and roll racks described above may also be configured in a wide variety of forms apart from those shown and described, and that they may include any number of shelves and horizontally and/or vertically oriented compartments as desired. Additionally, the features of the dividing units and roll racks may be combined in a variety of ways, with roll racks perhaps including horizontally spaced compartments (as in the dividing unit 400), and/or with dividing units including vertically spaced shelves whereupon rolls of wrapping material may be situated (as in the roll racks 500, 700, and 900). It should be further understood that it is not essential that a single roll rack be situated below the cabinet shelf within the cabinet interior and/or that a single dividing unit be situated above the cabinet shelf within the cabinet interior, and it is possible to provide multiple roll racks which fit adjacent to each other, and/or multiple dividing units which fit adjacent to each other. It is also possible to provide dividing units and/or roll racks in conjunction with other storage implements, such as drawers or boxes which removably insert within the roll racks and/or dividing units; drawers and/or boxes which removably insert into the cabinet interior adjacent to the dividing units and/or roll racks; or similar features. It is also not essential that roll racks and/or dividing units occupy the entirety of the cabinet interior above and/or below the cabinet shelf. Consider, for example, the storage unit workstation 100 of FIGS. 1 and 2 wherein the spindles 128 illustrated in FIG. 2 are removed, and the rolls of wrapping material are instead provided by a roll rack which fits within the cabinet interior 104 beneath the cabinet shelf 140 and also beneath the hooks 150 and bins 152.

It is emphasized that the foregoing list of possible modifications is not exhaustive. The listed variations are merely provided to illustrate versions of the invention that are regarded (at the time this document was drafted) to be particularly preferred. The invention is not intended to be limited to the preferred versions of the invention described above, but rather is intended to be limited only by the claims set out below. Thus, the invention encompasses all alternative versions of the invention that fall literally or equivalently within the scope of these claims.

What is claimed is:

1. A wrapping material storage unit/workstation comprising;

a cabinet having a cabinet interior bounded by opposing upper and lower cabinet walls and opposing side cabinet walls extending between the upper and lower cabinet walls;

a door having an interior door surface and an exterior door surface, the door being foldably affixed with respect to the cabinet to swing between a fully closed position wherein the interior door surface is situated over the cabinet interior and a fully open position at which the door rests in an at least substantially horizontal plane, the door thereby defining a working platform in front of the cabinet interior when in the fully open position;

said cabinet further comprising a first interchangeable set, said first interchangeable set including;

a spindle(s) extending at least substantially horizontally between the side cabinet wall, the spindle(s) being removeably affixed with respect to at least one of the side cabinet walls thereby a roll(s) of wrapping material may be mounted on the spindle(s) and one or more rip bars extending at least substantially parallel to the spindle and spaced therefrom, whereby wrapping material extending from the spindle may be forced against the rip bars to rip the wrapping material, a shelf situated within the cabinet interior above the spindle(s), whereby items may be stored on the shelf and away from a path defined between the spindle(s) and the working platform defined by the door resting in the fully open position, the items thereby being accessible from the working platform, but not interfering with wrapping material extending from the spindle(s) onto the working platform, said first interchangeable set can be removed and replaced with a second interchangeable set, said second interchangeable set comprising;

an insertable roll rack adapted to closely fit within the cabinet interior between at least one pair of opposing cabinet walls, the roll rack including;

a front rack wall having an access aperture defined therein, the access aperture being elongated in at least a substantially horizontal direction; and a rack shelf being situated beneath the access aperture whereby it may support a roll(s) of wrapping material thereon to supply the wrapping material through the access aperture situated above.

2. The wrapping material storage unit/workstation of claim 1 further comprising an elongated guide slot defined on the door through which wrapping material may be fit, the guide slot having a sharp edge against which wrapping material may be ripped.

3. The wrapping material storage unit/workstation of claim 2 wherein the guide slot is defined by an elongated bar affixed to the interior door surface adjacent to the cabinet.

4. The wrapping material storage unit/workstation of claim 3 wherein the interior door surface bears regularly spaced indicia thereon to allow measurement of wrapping material situated on the interior door surface.

5. The wrapping material storage unit/workstation of claim 3 wherein the interior door surface bears regularly spaced indicia thereon to allow measurement of wrapping material situated on the interior door surface.

6. The wrapping material storage unit/workstation of claim 1 wherein one or more foldable remaining arms extends between the cabinet and the door, and prevents the door from folding further away from the cabinet than its fully open position.

7. The wrapping material storage unit/workstation of claim 1, said second interchangeable set, further comprising an insertable dividing unit adapted to closely fit within a space in the cabinet interior above the shelf, the dividing unit bearing one or more partitioning walls which compartmentalize the space in the cabinet interior above the shelf.

8. The wrapping material storage unit/workstation of claim 7 wherein the dividing unit includes intersecting horizontal and vertical partitioning walls, and a support wall perpendicularly joining the horizontal and vertical partitioning walls, the support wall having apertures therein opening onto spaces between the horizontal and vertical partitioning walls.

9. The wrapping material storage unit/workstation of claim 1, said second interchangeable set, wherein the rack shelf slopes upwardly, thereby urging a roll of wrapping material thereon to ward the front rack wall.

10. The wrapping material storage unit/workstation of claim 1, said second interchangeable set wherein a portion of the rack self spaced distant from the front rack wall is angled upwardly and towards the front rack wall.

11. The wrapping material storage unit/material of claim 1 said second interchangeable set further comprising an insertable dividing unit adapted to closely fit within a space in the cabinet interior above the shelf, the dividing unit bearing one or more partitioning walls which compartmentalize the space in the cabinet interior above the shelf.

12. The wrapping material storage unit/workstation of claim 11 wherein the dividing unit includes intersecting horizontal and vertical partitioning walls, and a support wall perpendicularly joining the horizontal and vertical partitioning walls, the support wall having apertures therein opening onto spaces between the horizontal and vertical partitioning walls.

13. The wrapping material storage unit/workstation of claim 1 wherein one or more foldable restraining arms extends between the cabinet and the door, and prevents the door from folding further away from the cabinet than its fully open position.

* * * * *